United States Patent [19]

Schönmeier et al.

[11] 4,239,142

[45] Dec. 16, 1980

[54] BROAD-DRAWING APPARATUS

[75] Inventors: Herbert Schönmeier, Dusseldorf; Hartmut Dropczynski, Dormagen, both of Fed. Rep. of Germany

[73] Assignee: Jagenberg Werke Aktiengesellschaft, Dusseldorf, Fed. Rep. of Germany

[21] Appl. No.: 78,990

[22] Filed: Sep. 26, 1979

[30] Foreign Application Priority Data

Oct. 4, 1978 [DE] Fed. Rep. of Germany ..... 2843204

[51] Int. Cl.[3] ..... B65H 17/20

[52] U.S. Cl. ..... 226/194; 26/102

[58] Field of Search ..... 226/194, 176, 177, 179, 226/183, 187, 188; 26/51, 87, 97, 99, 101, 104

[56] References Cited

U.S. PATENT DOCUMENTS 3,679,115 7/1972 Stock ..... 266/177

3,684,146 8/1972 Fedrigo ..... 266/176

3,786,975 1/1974 Heymanns ..... 226/194

*Primary Examiner*—Leonard D. Christian

*Attorney, Agent, or Firm*—Sprung, Felfe, Horn, Lynch & Kramer

[57] ABSTRACT

A broad drawing apparatus for moving webs of material comprises a roll having a plurality of individual roll sections mounted on shaft sections and a two part thrust bearing for determining the degree of curvature for the two adjacent shaft sections of every two adjacent roll sections. A ball and socket bearing for each shaft section is provided such that the ball and socket bearings of adjacent shaft sections are disposed side by side on opposite sides of the thrust bearing and wherein each thrust bearing part carries one of the adjacent ball and socket bearings.

3 Claims, 5 Drawing Figures

BROAD-DRAWING APPARATUS

BACKGROUND OF THE INVENTION

The invention relates to a broad-drawing apparatus for moving webs of material, particularly webs of paper, whose roll consists of a plurality of individual sections mounted on shaft sections, a two-part thrust bearing determining the degree of curvature being provided for the adjacent shaft sections of every two adjacent roll sections.

A prior-art broad-drawing apparatus of this type (U.S. Pat. No. 3,786,975) makes it possible to prevent wrinkling of the web of paper, foil, cloth or the like by setting the roll by means of individual thrust bearings for a particular curvature at which slack web edges or individual sagging areas in specific zones over the width of the web are eliminated. The two-part bearing further permits individual roll sections to be inserted or removed without the whole broad-drawing roll having to be removed. For this purpose, adjacent shaft sections are provided with facing clutch portions of rectangular cross section which are surrounded by matching recesses in the corresponding thrust-bearing parts. In the assembled condition the thrust-bearing parts are in interlocking engagement with the clutch portions.

It has been found that with this type of engagement the tight fit between the thrust-bearing part and the clutch becomes loose in the course of operation since in the vertical positioning of the thrust bearings and in the removal and insertion of the individual roll sections the clutch portions execute a tilting or angular motion in the recesses of the thrust-bearing parts, and this leads to deformation of the material of construction. The result is unsteady motion and vibration in operation.

SUMMARY OF THE INVENTION

Against this background, the invention has as its object to provide a broad-drawing apparatus of the type outlined in which no loosening occurs in the area of the bearing seat even after operation over an extended period of time and in which provision is made for individual roll sections to be replaced without the whole broad-drawing roll having to be removed.

In accordance with the invention, this object is accomplished in that each shaft section is provided with its own ball-and-socket bearings, and that the ball-and-socket bearings of adjacent shaft sections are disposed side by side on opposite sides of the thrust bearing, each thrust-bearing part carrying one of the adjacent ball-and-socket bearings.

To permit the easy removal of individual roll sections from one side of the broad-drawing roll or the other, it is advisable to arrange the ball-and-socket bearings and the thrust-bearing parts in a specific combination. In accordance with the combination, the thrust-bearing parts for the ball-and-socket bearings associated with a given shaft section are disposed on the same side of the shaft section.

The ball-and-socket bearings are preferably fastened to the lateral surfaces of the associated thrust-bearing part which face the roll sections so that the two thrust-bearing parts abut on each other along a continuous line of contact. This results in a stable bearing seat.

In accordance with a further characteristic of the invention, each shaft section is nonrotatably held to the associated ball-and-socket bearing. For this purpose, a bearing eye of the ball-and-socket bearing may be provided with a radial recess in which a pin fixed in the associated shaft section is guided. This provides assurance against relative rotation between the ball-and-socket bearing and the shaft section.

BRIEF DESCRIPTION OF THE DRAWINGS

The invention will now be described in greater detail with reference to the drawing illustrating an embodiment, wherein.

DETAILED DESCRIPTION OF THE INVENTION

Figure 1:
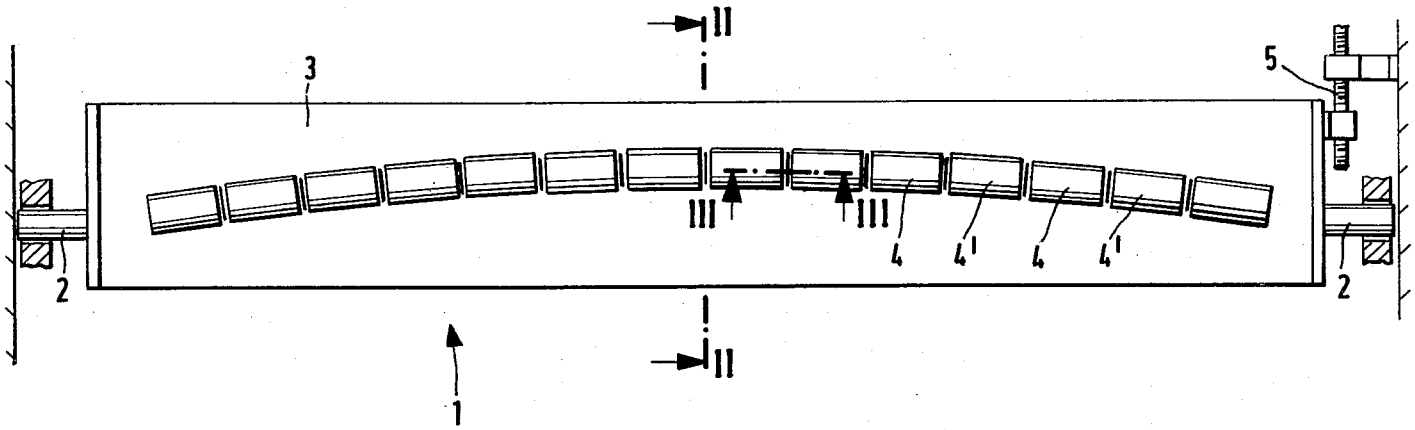
FIG. 1 is a top plan view of a broad-drawing apparatus according to the present invention.

The broad-drawing apparatus 1 is arcuately disposed on a crossbeam 3 pivotally mounted by means of shafts 2. It consists of a plurality of roll sections 4 and 4' disposed side by side. A pull rod 5, by which the broad-drawing apparatus 1 can be swung toward the paper web to be broad-drawn engages the crossbeam 3. The individual roll sections 4 and 4' are carried by flat, two-part thrust bearings 7 which extend between every two adjacent roll sections 4 and 4'. The two parts of the thrust bearing 7 are held together by being bolted by screws 11 at their lower edge to a common bar 10 having bar sections 10'. The bar 10, and hence the thrust bearing 7, are carried by an adjusting pin 6 which is threaded into the crossbeam 3. The adjusting pin 6 permits the individual roll sections 4 and 4' to be set for a particular curvature of the broad-drawing apparatus 1.

Figure 4:
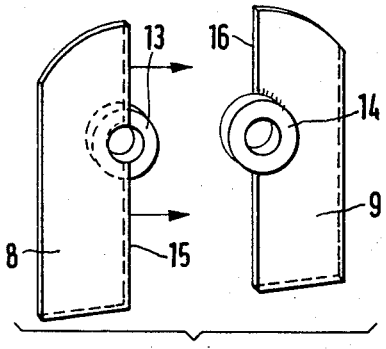
FIG. 4 is a perspective view of a thrust bearing.

In the assembled condition, the two parts 8 and 9 of the two-part thrust bearing 7 abut on each other by their faces 15 and 16 to form a common line of contact. Each part 8 and 9 has a bearing eye 13 and 14 which is secured to the associated part 8 or 9, respectively, by welding, for example. As is apparent from FIG. 4, the bearing eyes 13 and 14 are fixed to the outside of the associated parts 8 and 9 of the thrust bearing 7 only to the extent of one-half so that in the assembled condition their axes are aligned with each other.

Figure 3:
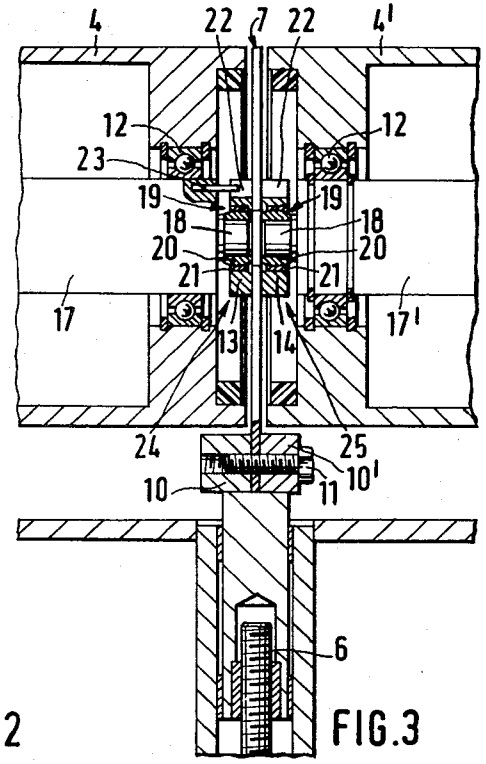
FIG. 3 is an axial section through the broad-drawing apparatus according to FIG. 1, taken along the line III—III in FIG. 1.
Figure 2:
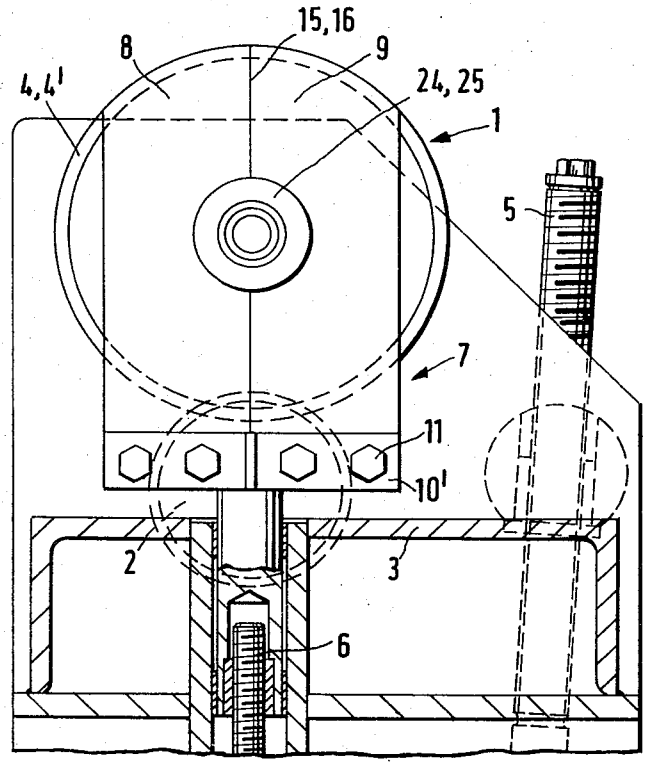
FIG. 2 is a cross section through the broad-drawing apparatus according to FIG. 1, taken along the line II—II in FIG. 1.

As may be seen particularly from FIG. 3, the circumferences of the adjacent roll sections 4 and 4' extend almost all the way to the thrust bearing 7 so that uniform support of the paper web is assured. Every roll section 4 and 4' is mounted by means of a ball bearing 12 so as to rotate freely on a shaft section 17 and 17' whose journals are seated in the ball-and-socket bearings 19. Each ball-and-socket bearing consists of an inner ring 20 with a convex outer surface and an outer ring 21 with a correspondingly curved concave inner surface. Every outer ring 21 is seated in one of the bearing eyes 13 or 14, respectively, which, as mentioned above, are fastened to part 8 or 9, respectively, of the thrust bearing 7. The parts 13 and 19, and 14 and 19, form a ball-and-socket bearing 24 and 25, respectively. Each bearing eye 13 and 14 has a radial recess 22 in which a pin fixed in the shaft section 17 and 17', respectively, is guided in the direction in which the adjusting pin 6 acts. In this way, each shaft section 17 and 17' is secured against rotation; however, every two adjacent shaft sections 17 and 17' are free to move in the direction in which the adjusting pin 6 acts, and the thrust bearings 7 therefore can be set without constraint.

Figure 5:
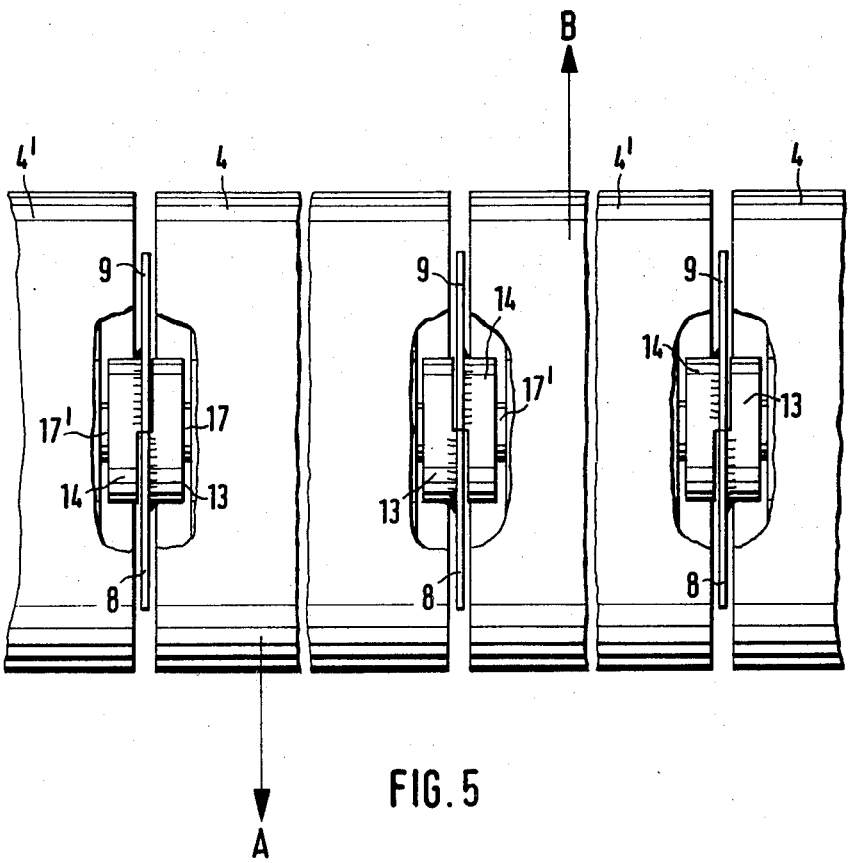
FIG. 5 is a top plan view of a portion of the length of a broad-drawing roll according to the invention.

In operation, the broad-drawing apparatus 1 is swung toward the paper web to be broad-drawn by a swinging motion of the crossbeam produced by the pull rod 5. If the existing curvature of the broad-drawing apparatus 1 is not sufficient to smooth the paper web, an individual adjustment can be made by means of the adjusting pin 6 of the thrust bearings 7. When an individual roll section 4 or 4' is to be removed, all that need to be done is to release the mounting screws 11 and the bar sections of the thrust-bearing parts 8 and 9 which support the corresponding roll sections 4 and 4'. In order that the roll sections 4 and 4' may be readily removed from one side or the other, in other words, in the direction indicated by the arrow A or B in FIG. 5, a specific combination is contemplated in the arrangement of the thrust-bearing parts 8 and 9 and the bearing eyes 13 and 14. As is apparent from FIG. 5, the bearing eyes 13 associated with the shaft section 17 are fixed to the thrust-bearing parts 8, disposed on the same side of the shaft section 17, while the bearing eyes 14 associated with the adjacent shaft section 17' are disposed on the other side of the shaft section 17'. This combination in the arrangement of said parts makes it possible to remove the shaft section 4 in the direction of the arrow A, and the shaft section 4' in the direction of the arrow B, without any jamming or canting occurring.

It will be appreciated that the instant specification and claims are set forth by way of illustration and not limitation, and that various changes and modifications may be made without departing from the spirit and scope of the present invention.

What is claimed is:

1. A broad-drawing apparatus for moving webs of material such as paper, comprising: a roll having a plurality of individual roll sections mounted on shaft sections, a two-part thrust bearing for determining the degree of curvature being provided for the two adjacent shaft sections of every two adjacent roll sections, ball-and-socket bearing for each shaft section, wherein the ball-and-socket bearings of adjacent shaft sections are disposed side by side on opposite sides of the thrust bearing and wherein each thrust-bearing part of each two part thrust bearing carries one of the adjacent ball-and-socket bearings.

2. A broad-drawing apparatus according to claim 1, wherein each of the two thrust-bearing parts for a given shaft section are disposed on the same side of the shaft section.

3. A broad-drawing apparatus according to claim 1 or claim 2, further comprising means mounting each shaft section in a nonrotatable state relative to the associated ball-and-socket bearing.

* * * * *